United States Patent [19]

Schwelling

[11] Patent Number: 5,014,920

[45] Date of Patent: May 14, 1991

[54] PAPER SHREDDER

[76] Inventor: Hermann Schwelling, Hartmnnweg 5, D-7777 Salem 2, Fed. Rep. of Germany

[21] Appl. No.: 489,950

[22] Filed: Mar. 7, 1990

[30] Foreign Application Priority Data

Mar. 7, 1989 [DE] Fed. Rep. of Germany ..... 3907316

[51] Int. Cl.[5] ..... B02C 23/00

[52] U.S. Cl. ..... 241/101.2; 241/36

[58] Field of Search ..... 241/33, 36, 101.2; 74/1 R, 843, 847, 848

[56] References Cited

U.S. PATENT DOCUMENTS

| | | | |
|---|---|---|---|
| 3,703,970 | 11/1972 | Benson | 241/241 |
| 4,026,480 | 5/1977 | Meyers | 241/30 |
| 4,034,918 | 7/1977 | Culbertson et al. | 241/36 |
| 4,545,537 | 10/1985 | Kimura et al. | 241/36 |
| 4,609,155 | 9/1986 | Barnier | 241/36 X |
| 4,721,257 | 1/1988 | William et al. | 241/36 |
| 4,793,561 | 12/1988 | Burda | 241/36 |
| 4,919,345 | 4/1990 | Burlington et al. | 241/36 |

*Primary Examiner*—Timothy V. Eley

*Attorney, Agent, or Firm*—Nils H. Ljungman & Associates

[57] ABSTRACT

A drive unit for a knife roller of a shredder having an electric motor to which a motor reduction gear transmission is attached. Recesses are located on both sides of the plane sides of the intermediate gear wheel. Each of the stop surfaces, which are located across from each other, work in cooperation with the in corresponding catch pin on the corresponding free shaft end of the knife roller drive shaft. The stop surfaces and their catch pin represents a free wheeling clutch for forward and reverse start up. There are two catch pins with each their own stop surfaces on each side of the gear wheel.

20 Claims, 2 Drawing Sheets

PAPER SHREDDER

1. FIELD OF THE INVENTION

The present invention relates to shredders and more, particularly, to mechanisms for shredders.

2. BACKGROUND INFORMATION

The invention relates to a knife roller drive, especially suited for paper shredders or other file destroyers. Such a drive, equipped with a partially free-wheeling or override clutch or coupling, is known, among others, from German Patent No. 16 11 752. This "override clutch" primarily serves the purpose of being adapted for supplying a sufficient amount of torque, in the case of an operational breakdown caused by the clogging or jamming of the material being cut. The override clutch also serves the purpose of supplying sufficient amounts of torque for the free-wheeling of the knife roller in reverse, as well as during the restarting process after the cleaning of the jam or clog in forward under load. The known speed or rpm reduction transmissions, having teeth belts and corresponding belt pulleys, have for the purpose of supplying a sufficient amount of torque a pin located at the end of a knife roller shaft which functions together with the belt drive pulley which pulley is located in the plane of the belt. The belt drive pulley is equipped with a stop with two stop surfaces. This known type of override or partially free-wheeling clutch or coupling may work satisfactorily with an rpm reduction transmission which utilizes belts with teeth. This type of override clutch, as described above, will not, however, work especially well with such reduction transmissions which primarily consist of gear wheels. Particularly gear wheels made from synthetic materials such as plastic and composites, for instance, such synthetically made gear wheels have gained more and more usage in mass production, thereby, creating a need for the invention embodied in such an arrangement as set forth below. One disadvantage of using a single pin in such a partially free-wheeling coupling would be the asymmetrical or uneven load placed on a synthetic gear wheel by the clutch or coupling pin which could distort or forcefully tilt the respective gear wheel against the pinion gear wheel, thus leading to sporadic or localized stress on the teeth of the synthetic gear wheel. This distortion of the gear and the tooth, making contact with the other gear, could result in an additional disadvantage which would be the increased wear and tear on the teeth, if not even total destruction of the synthetic gear teeth and/or wheel.

Another shredder with increased reverse unlocking torque is found in U.S. Pat. No. 4,545,537. Other patents which may possibly be of some interest are U.S. Pat. Nos. 4,034,918; 4,026,480: and 3,703,970.

OBJECT OF THE INVENTION

It is the object of the instant invention to provide an apparatus and a process to avoid the uneven load, or tilting or spiraling of the respective gear wheel and its teeth against the pinion, thereby, reducing the wear and tear on the gear teeth of the drive roller mechanism as mentioned.

SUMMARY OF THE INVENTION

One aspect of the invention resides broadly in a shredder for shredding waste products such as paper, plastic and the like, the shredder comprising; a shredding wheel means for cutting and shredding waste products; a motor means for driving the shredding wheel means; a transmission means disposed between the shredder wheel means and the motor means to supply torque from the motor means to the shredder wheel means; the transmission means comprising; a plurality of pin means disposed for driving the shredding wheel means by transforming torque from the motor means to the shredding wheel means; each of the pin means having associated therewith a corresponding first surface means and a corresponding second surface means both disposed for making intermediate and selective contact with their associated pin means; each of the first surface means being disposed to make contact with its associated pin means for driving the shredding wheel means in a forward direction of rotation for shredding waste products; each of the second surface means being disposed to make contact with its associated pin means for driving the shredding wheel means in a reverse direction of rotation opposite the forward direction of rotation; each of the first surface and each of the second surface being disposed for permitting the motor means to gain speed upon movement of their associated pin means between each of the first surface means and each of the second surface means; at least one drive element for being driven by the motor means and for driving the shredding wheel means; the at least one drive element having a first side and a second side opposite of the first side; a first and a second of the plurality of pin means, each with its associated first surface and second surface, being disposed, one on each of the first side and the second side of the drive element, for distributing stress substantially evenly through portions of the drive element at least in the reverse direction of rotation.

BRIEF DESCRIPTION OF THE DRAWINGS

The invention will be explained in more detail with the help of the following embodiment examples.

DESCRIPTION OF THE PREFERRED EMBODIMENTS

Figure 1:
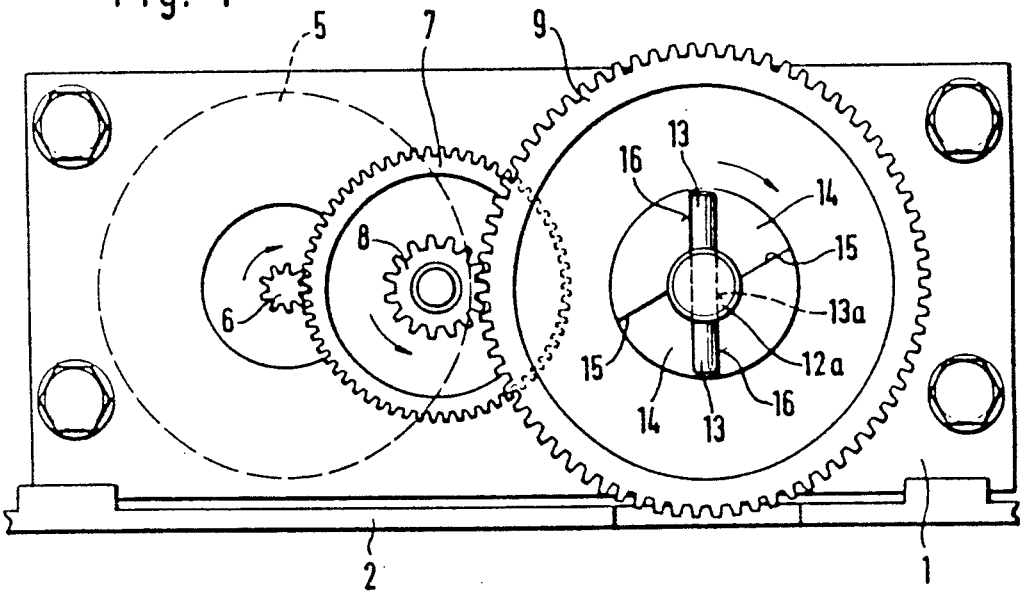
FIG. 1 is a front partial view of the transmission, which connects the motor drive shaft with the knife roller.
Figure 2:
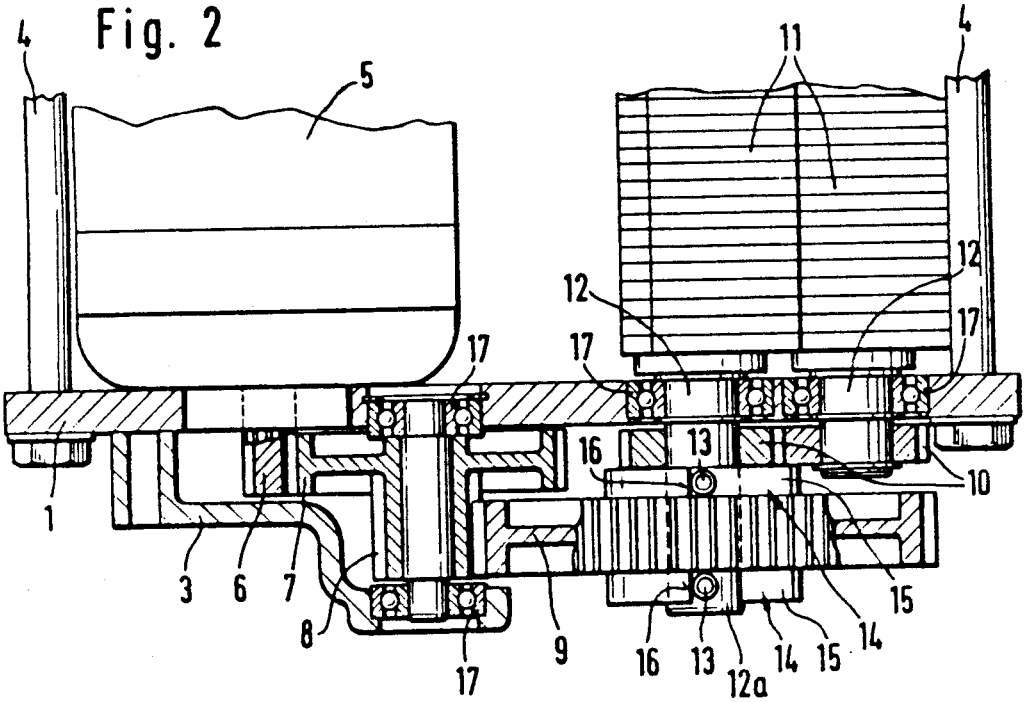
FIG. 2 is a top view of an embodiment of the invention with the housing cover removed therefrom.
Figure 3:
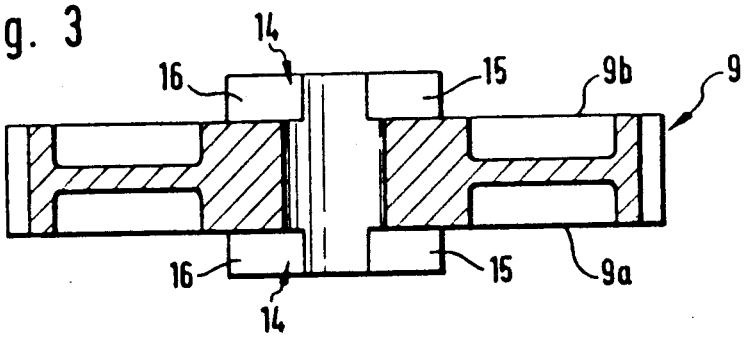
FIG. 3 is a cross-sectional view of the gear wheel having the partially free-wheeling coupling as a part thereof.

In the illustrated embodiments, knife rollers 11, for example, are located in a side piece or side covering portion of a frame arrangement 1. The knife rollers 11 are preferably held in the side pieces by means of ball bearings 17. The side piece 1 together with a bottom frame 2 and a diagonal bracket 4 form the frame of the shredder or file destroyer for shredding paper, plastic or other material. Additionally, attached to side piece 1 is an electric drive motor 5, in the form of a reversible motor and a bearing plate 3 to contain a gear wheel 7, which meshes with a drive pinion 6 of the motor 5. In the assembly of gear wheel 7, intermediate pinion 8 is connected to gear wheel 7 and rotates therewith and is stationary with respect thereto. The intermediate pinion 8 itself has meshed connection with an interim gear 9. The interim gear 9 is loosely attached to the elongation **12*a* of the roller shaft 12. This elongation 12*a* of the knife roller shaft 12 can pivot within the interim gear 9**.

The reduction transmission for the counter-rotating drive connection for the knife rollers, is completed with a gear wheel pair 10. One of the gears 10 is attached to the knife roller shaft 12 and drives the other of these gears.

The actual override clutch or partially free-wheeling coupling includes the two plane sides 9a and 9b of the interim gear 9, each having a recess 14 on either side of the hub area of the intermediate gear 9. Only one side of the gear 9 will be described for ease of understanding. However, it should be understood that there are preferably two symmetrically disposed free wheeling structures on each side of the intermediate gear 9. This first recess 14 is shown as being preferably in the order of about 60 degrees to about 70 degrees wide. Stop surface 15 and 16, at the beginning and end of the recess 14 limit relative movement of a catch pin 13 between the stop surfaces 15 and 16 on both sides of the movement of the pin 13 in the recess 14. A drive shaft extension 12a holds the catch pin 13 which extends radially outwardly on both sides of the shaft 12a. The drive shaft extension 12a and the catch pin 13 are attached to knife roller shaft 12. In use, the catch pin 13 slams against the corresponding stop surfaces 15 and 16 of the recess 14 when the motor starts in a forward or reverse direction of rotation.

The functioning principle of this device is as follows:

If the motor 5, for instance, stops in a known way for reason of clogging during forward operation, the reversing switch of the motor is switched from forward to reverse. The catch pin 13 which, for example, was resting against stop surface 15 when the motor was running in a forward direction indicated by the arrow in FIG. 1 will then run backward through the free space of the recess 14, and the motor preferably attains or begins to attain its full torque or a torque greater than stand still torque as the pin 13 moves backward, counter clockwise in FIG. 1, between the surface 15 to the surface 16. The pin 13 then hits the surfaces 16 with sufficient force to thereby preferably immediately open the clogging in most cases. Since there is a pin 13 on both of the side pistons of the intermediate gear 9, the force transmitted to each side of the intermediate gear 9 is substantially similar in magnitude thereby preferably avoiding the uneven loading and distortion associated with a single pin 13 only on one side of the gear 9. This embodiment is especially applicable to plastic or composite gears which distort far more easily than metal gears and thus plastic gears with a single sided pin 13 often wear out much more rapidly than the double sided arrangement of the present invention. The best effect is achieved in this new structure by additional rotating symmetrical arrangements of the clutch components 13 through 17 on both end or substantially plane sides 9a and 9b of the corresponding gear wheel 9.

In summary one feature of the invention resides broadly in a shredder consisting of an electromotor 5, with reduction gear transmission 6, 7, 8, 9, 10 and a so called overriding clutch in the form of a catch pin 13 on one end of shaft 12 of the knife roller 11, in the knife roller rotation plane there is a drive wheel 9 on the same shaft end 12. The drive wheel 9 has a stop arrangement with two stop surfaces 15 and 16. The invention is characterized by the fact that at least the components of the reduction gear transmission 6, 7, 8, 9, 10, are developed as a gear wheel transmission and that the clutch components 13, 14, 15, 16 are attached in a mirror image like fashion on both sides 9a and 9b, which may be called intermediate gears.

Another feature of the invention resides broadly in a drive mechanism which is characterized by additional symmetrically rotating arrangement of clutch components 13, 14, 15, 16 on both plane sides 9a and 9b of the corresponding gear wheel 9.

In further summary, the invention relates to a drive unit for a knife roller 11 of a shredder having an electric motor 5 through which motor reduction gear transmission 6 through 10 are attached. Recesses 14 are located on both sides of the plane sides 9a and 9b of the intermediate gear wheel 9. Each of the stop surfaces 15 and 16, which are located across from each other, work in cooperation with the corresponding catch pin 13 on the corresponding free shaft end 12a of the knife roller drive shaft 12. The stop surfaces 15 and 16 and their catch pin 13 represents a free wheeling clutch for forward and reverse start up. There are two catch pins with each of their own stop surfaces 15 and 16 on each side of the gear wheel 9.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A shredder for shredding waste products, said shredder comprising;

shredding wheel means for cutting and shredding waste products;

motor means for driving said shredding wheel means;

transmission means disposed between said shredder wheel means and said motor means to supply torque from said motor means to said shredder wheel means;

said transmission means comprising;

a plurality of pin means disposed for driving said shredding wheel means by transferring torque from said motor means to said shredding wheel means;

each of said pin means having associated therewith a corresponding first surface means and a corresponding second surface means both disposed for making intermediate and selective contact with their associated pin means;

each said first surface means being disposed to make contact with its associated pin means for driving said shredding wheel means in a forward direction of rotation for shredding waste products;

each said second surface means being disposed to make contact with its associated pin means for driving said shredding wheel means in a reverse direction of rotation opposite the forward direction of rotation;

each said first surface and each said second surface being disposed for permitting the motor means to gain speed upon movement of their associated pin means between each said first surface means and each said second surface means;

at least one drive element for being driven by said motor means and for driving said shredding wheel means;

said at least one drive element having a first side and a second side opposite said first side;

a first and a second of said plurality of pin means, each with its associated first surface and second surface, being disposed, one on each of said first side and said second side of said drive element; and said first and said second of said plurality of said pin means being disposed for distributing stress substantially evenly through portions of said drive element at least in the reverse direction of rotation.

2. The shredder according to claim 1, wherein said at least one drive element has a plane of symmetry disposed between said first and second pin means;

said first and second pin means and each of their corresponding first and second surface means being mirror image symmetrical with respect to the plane of symmetry of said drive element.

3. The shredder according to claim 2, wherein said drive element comprises a drive gear for driving said shredding wheel means.

4. The shredder according to claim 3, wherein said first and second pin means and each of their corresponding first and second surface means being disposed in a hub area of said drive gear.

5. The shredder according to claim 4, wherein each said pin means is disposed on a drive shaft connected to said shredder wheel means, and said drive shaft for driving said shredder wheel means.

6. The shredder according to claim 5, wherein each of said first surface means and said second surface means being disposed on said drive gear in the hub area of said drive gear.

7. The shredder according to claim 6, wherein said drive gear comprises at least thereof teeth made of at least one of: a synthetic material, an elastomer, a rubber material and a composite material.

8. The shredder according to claim 7, wherein each of said pin means is disposed on a shaft for driving said shredding wheel means; and two of said first surfaces and two of said second surfaces associated with said two first surfaces are disposed in the hub of said drive gear.

9. The shredder according to claim 5, wherein said drive gear comprises at least thereof teeth made of at least one of: a synthetic material, an elastomer, a rubber material and a composite material.

10. The shredder according to claim 4, wherein said drive gear comprises at least thereof teeth made of at least one of: a synthetic material, an elastomer, a rubber material and a composite material.

11. The shredder according to claim 3, wherein said drive gear comprises at least thereof teeth made of at least one of: a synthetic material, an elastomer, a rubber material and a composite material.

12. The shredder according to claim 1, wherein said drive element comprises a drive gear for driving said shredding wheel means.

13. The shredder according to claim 12, wherein said first and second pin means and each of their corresponding first and second surface means being disposed in a hub area of said drive gear.

14. The shredder according to claim 13, wherein each said pin means is disposed on a drive shaft connected to said shredder wheel means, and said drive shaft for driving said shredder wheel means.

15. The shredder according to claim 14, wherein each of said first surface means and said second surface means being disposed on said drive gear in the hub area of said drive gear.

16. The shredder according to claim 15, wherein said drive gear comprises at least thereof teeth made of at least one of: a synthetic material, an elastomer, a rubber material and a composite material.

17. The shredder according to claim 15, wherein each of said pin means is disposed on a shaft for driving said shredding wheel means; and two of said first surfaces and two of said second surfaces associated with said two first surfaces are disposed in the hub of said drive gear.

18. The shredder according to claim 14, wherein said drive gear comprises at least thereof teeth made of at least one of: a synthetic material, an elastomer, a rubber material and a composite material.

19. The shredder according to claim 13, wherein said drive gear comprises at least thereof teeth made of at least one of: a synthetic material, an elastomer, a rubber material and a composite material.

20. The shredder according to claim 12, wherein said drive gear comprises at least thereof teeth made of at least one of: a synthetic material, an elastomer, a rubber material and a composite material.

* * * * *